US005772612A

United States Patent [19]

Ilan

[11] Patent Number: 5,772,612

[45] Date of Patent: Jun. 30, 1998

[54] STRETCHING METHOD FOR PREVENTING OR RELIEVING LOWER BACK PAIN

[76] Inventor: Daniel Ilan, 24 Hamatmid, Even Yehuda, Israel

[21] Appl. No.: 671,120

[22] Filed: Jun. 17, 1996

[51] Int. Cl.[6] ..... A61H 1/00

[52] U.S. Cl. ..... 601/23; 601/35; 606/241; 482/131; 482/907

[58] Field of Search ..... 601/5, 23, 24, 601/26, 27, 29, 31–35; 602/36; 606/241; 128/845, 878; 482/79, 80, 131, 132, 133–137, 139, 148, 907

[56] References Cited

U.S. PATENT DOCUMENTS

| | | | |
|---|---|---|---|
| 1,804,441 | 5/1931 | Silva . | |
| 3,094,324 | 6/1963 | Shingleton | 482/131 |
| 3,895,795 | 7/1975 | Merz . | |
| 4,292,962 | 10/1981 | Krause . | |
| 4,463,947 | 8/1984 | Kloenne . | |
| 4,602,619 | 7/1986 | Wolf et al. | 606/241 |
| 4,793,608 | 12/1988 | Mahnke et al. . | |
| 4,838,249 | 6/1989 | Jannotta et al. | 601/23 |
| 4,848,742 | 7/1989 | Lindley et al. . | |
| 5,070,863 | 12/1991 | McArthur et al. . | |
| 5,147,267 | 9/1992 | Kunewalder . | |
| 5,205,804 | 4/1993 | Hall . | |
| 5,374,230 | 12/1994 | Bonnaime . | |
| 5,403,258 | 4/1995 | Hill . | |

*Primary Examiner*—Jeanne M. Clark
*Attorney, Agent, or Firm*—Mark M. Friedman

[57] ABSTRACT

A therapeutic method, for simultaneously stretching and lifting a user's lower back while the user is lying on his back on the ground, thereby relieving and preventing lower back pain. The device includes a frame which features a horizontally extending upper cross frame for accommodating the back of the user's knees. In use, the lower end of the frame contacts the ground and serves as a fulcrum. The device further includes a foot rest for accommodating the user's feet. The foot rest is mounted to the frame at a convenient point between the cross frame and the lower end.

5 Claims, 3 Drawing Sheets

FIG. 1
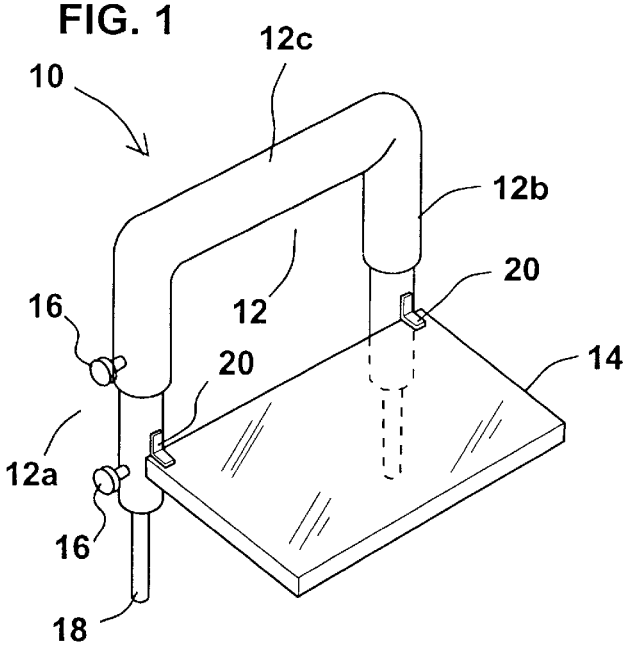
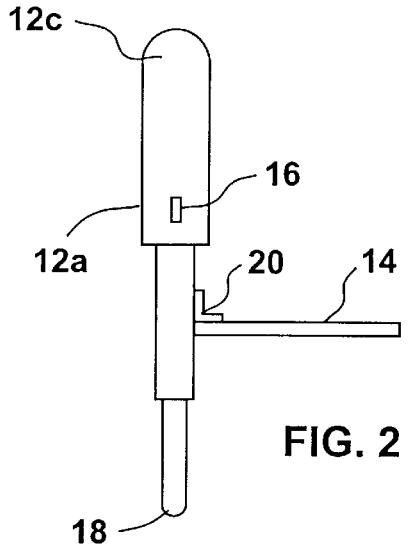
FIG. 2
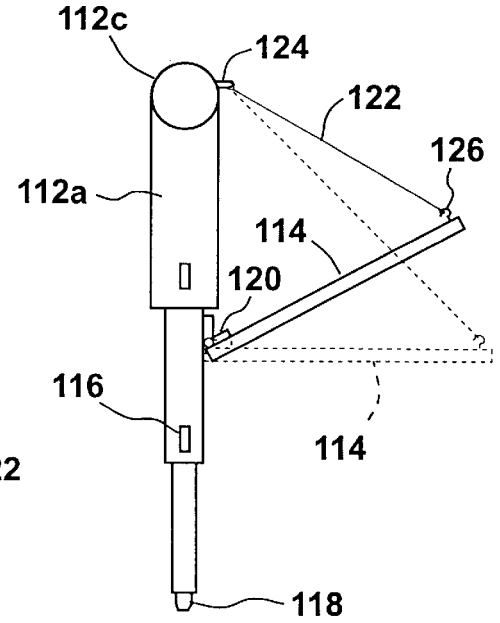
FIG. 5
FIG. 4
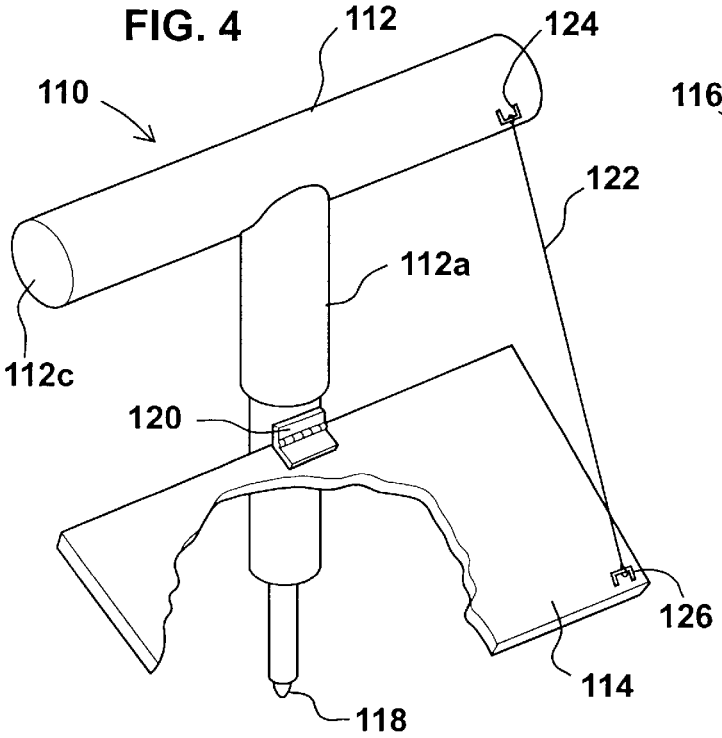

FIG. 6
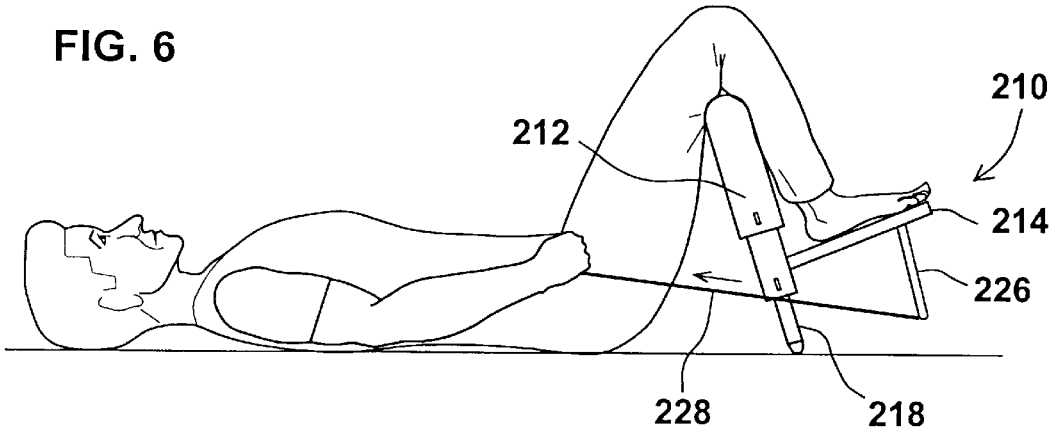
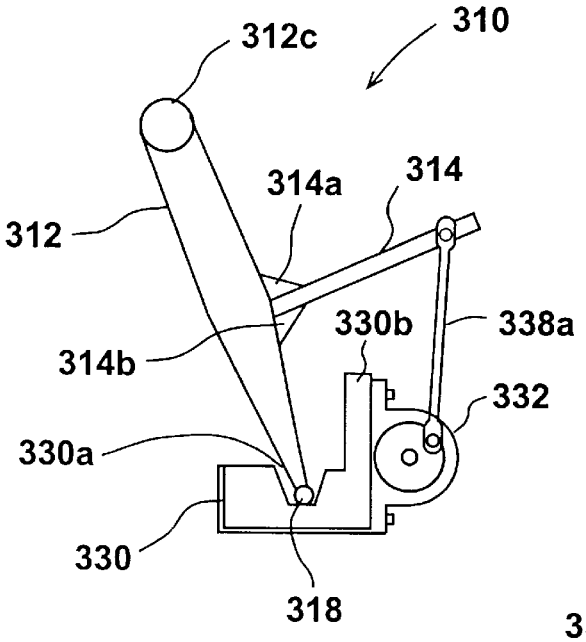
FIG. 7
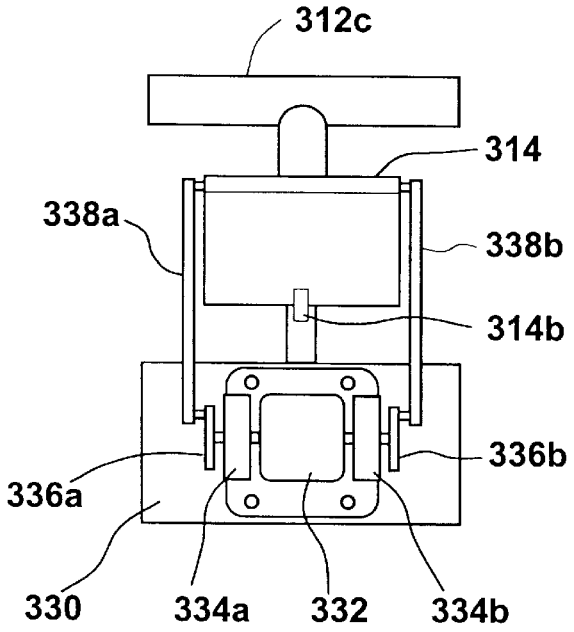
FIG. 8

STRETCHING METHOD FOR PREVENTING OR RELIEVING LOWER BACK PAIN

FIELD AND BACKGROUND OF THE INVENTION

The present invention relates to a stretching device, particularly useful for the relieving or preventing of lower back pains.

It is well known that lower back pains affect a very large portion of adults, especially middle aged adults and older. As a consequence, a great deal of suffering and disability is experienced by a large fraction of the population resulting, among other things, in a large number of lost work days and greatly diminished quality of life.

A brief physiological analysis will help illustrate the cause of back pains and give an insight as to possible remedies.

The spinal column consists of thirty three vertebrae which are joined together by cartilage tissue and ligaments. The upper twenty four vertebrae are discrete and movable while the lower nine vertebrae are fixed. Five of the lower nine vertebrae are fused together to form the sacrum while the terminal four vertebrae are normally fused to form the coccyx. The normal spinal column may be considered to have seven cervical, twelve thoraic, five lumbar, five sacral and four coccygeal vertebrae. Mobility of the vertebrae in the cervical, thoraic and lumbar regions is relatively free compared with movement of the fused vertebrae of the sacrum and coccyx which is relatively constrained.

The main causes of common back pain are the continual stresses and strains experience by the lower back region which is the major, albeit not the sole, weight supporting element of the upper body.

These stresses and strains eventually cause the damage symptomatic of back pain in that the cartilage material forming the discs separating the vertebrae is worn away over a period of time. In its extreme pathological condition, the patient may develop anchilosing spondylitis, namely, the partial, bent-down stiffening of the spinal column.

The sensation of pain is felt because the distance separating the vertebrae becomes narrower, causing pressure to be exerted on the nerve roots which extend from the spinal cord.

Due to the degenerative nature of the causes of back pain of this sort there is currently no permanent relief available, except for surgery where appropriate. There are, however, a multitude of known procedures for the relief of pain in the lumbar region of the back. These procedures involve the stretching of the lower back to achieve the separation of the discs in the affected lumbar area. However, these treatments typically require the use of weights and other mechanical equipment and must be undertaken only under close professional supervision.

There is thus a widely recognized need for, and it would be highly advantageous to have, an inexpensive and simple device for the effective relief or prevention of pain in the lumbar region of the back. The use of such a device, which will be adjustable to match the physiology of the user, will require no professional supervision, will require minimal setup and will easily fold into a space-saving shape for easy transport.

SUMMARY OF THE INVENTION

According to the present invention there is provided a therapeutic device for simultaneously stretching and lifting a user's lower back while the user is lying on his back on the ground, thereby relieving and preventing lower back pain, the device comprising: (a) a frame including an upper cross frame member for accommodating the back of the user's knees, said upper cross frame member extending substantially horizontally, said frame having a lower end for contacting the ground and serving as a fulcrum; and (b) a foot rest member for accommodating the user's feet, said foot rest member mounted to said frame at a point intermediate said upper cross frame member and said lower end.

Also according to the present invention, there is provided a method for relieving and preventing lower back pains, comprising the steps of: (a) providing a device for simultaneously stretching and lifting a user's lower back, the device including: (i) a frame including an upper cross frame member extending substantially horizontally, said frame having a lower end for contacting the ground and serving as a fulcrum; and (ii) a foot rest member mounted to said frame at a point intermediate said upper cross frame member and said lower end; (b) lying with the user's back on the ground; (c) holding said so that said lower end is on the ground while said upper cross frame member is elevated relative to the ground; (d) placing the user's legs over said device so that the user's feet rest on said foot rest member while the back of the user's knees rests substantially on said upper cross frame member; and (e) rocking said device back and forth about said lower end of said frame by periodically pushing on said foot rest member so as to simultaneously lift and stretch the user's lower back.

According to further features in preferred embodiments of the invention described below, the frame is adjustable so as to vary the height of the upper cross frame member above the ground and/or the height of said foot rest member relative to said upper cross frame member.

According to still further features in the described preferred embodiments the angle between the foot rest member and the frame is adjustable.

BRIEF DESCRIPTION OF THE DRAWINGS

The invention is herein described, by way of example only, with reference to the accompanying drawings, wherein:

FIG. 1 is a perspective view of the first embodiment of the invention;

FIG. 2 is a side view of the device shown in FIG. 1;

FIG. 4 is a perspective view of the second embodiment of the invention;

FIG. 5 is a side view of the device shown in FIG. 4;

FIG. 6 is an elevation view of a modified embodiment of the invention in use during an exercising period;

FIG. 7 is a side view of a further modified embodiment of the invention; and FIG. 8 is a front view of the device shown in FIG. 7.

DESCRIPTION OF THE PREFERRED EMBODIMENTS

Figure 3A:
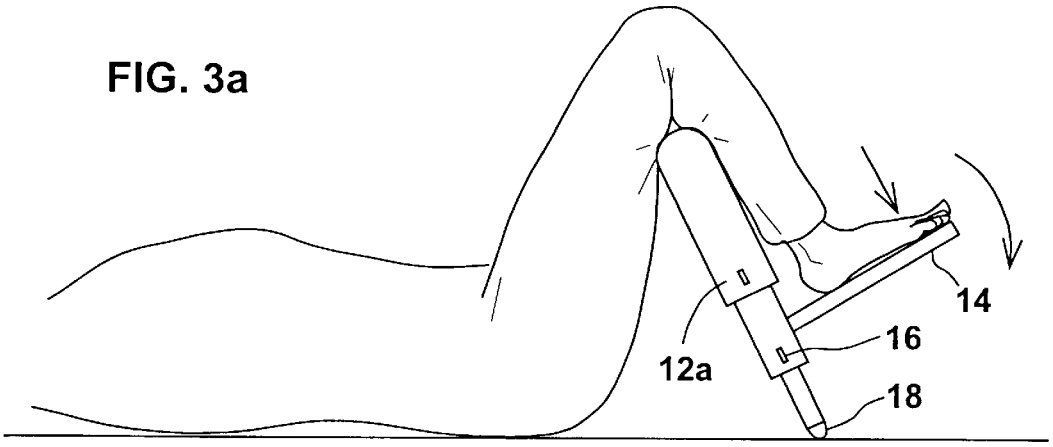
FIGS. 3*a*–3*c* illustrate a series of positions of the device in use during an exercising cycle.

The present invention is of devices for prevention and/or relieving lower back pains.

The principles and operation of devices according to the present invention may be better understood with reference to the drawings and the accompanying description.

Referring now to the drawings, FIGS. 1 and 2 illustrates a typical embodiment of a device according to the present invention, generally denoted 10. Device 10 preferably includes an upright tubular inverted U-shaped frame 12 and a substantially flat footrest member 14. Frame 12 preferably includes legs or pedestal members 12*a* and 12*b*, and a web member 12*c*.

In order to allow adjustments to be made to the configuration of device 10 when in use to meet the user's individual requirements, as will be described later, each leg 12*a* and 12*b* is preferably formed so as to be adjustable in height, for example, through use of a three-part telescopic assembly to form each leg 12*a* and 12*b*. User-adjustable setting mechanisms, such as set screws 16 may then be provided for adjusting the overall height of web member 12*c* as well as the height of foot rest member 14 above the ground and the distance between web member 12*c* and foot rest 14. Thus, the critical dimensions of device 10 may be readily adjusted to match the physiology of the user.

Preferably, the lowermost portions of legs 12*a* and 12*b* are fitted with suitable non-slip members 18 to prevent the slipping of device 10 during use.

Web 12*c* is optionally covered with a cushioned pad to enhance the conform of the user and prevent abrasive sores on contact areas of the legs being formed by continuous and repeated use of device 10. Foot rest member 14 is preferably connected to the pair of intermediate telescopic elements, which places it at approximately one half of the height of frame 12. Preferably, foot rest member 14 is hingedly connected to legs 12*a* and 12*b* using suitable hinges 20. The hinged connection is provided to allow individualized adjustment and also to facilitate more convenient stowing away of the device when not in use. Thus, the use of hinges 20 makes it possible to pivot foot rest member 14 so that it becomes substantially parallel to legs 12*a* and 12*b* so as to reduce the overall volume of device 10.

The dimensions and location of web 12*c* and of foot rest member 14 are such that the user may comfortably place his legs side by side over device 10 so that the soles of both feet rest comfortably on foot rest member 14 while the portion of the legs immediately behind the knees is partially wrapped around web 12*c*.

Figure 3B:
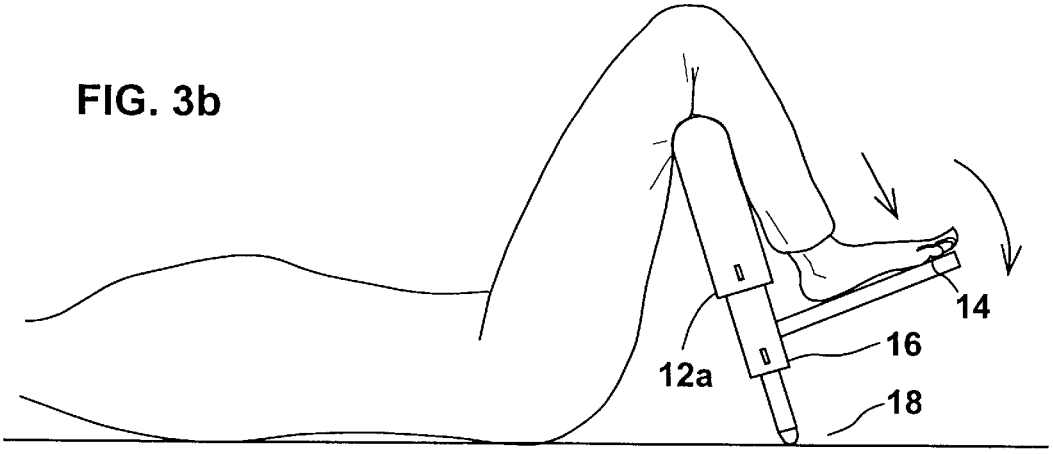
Figure 3C:
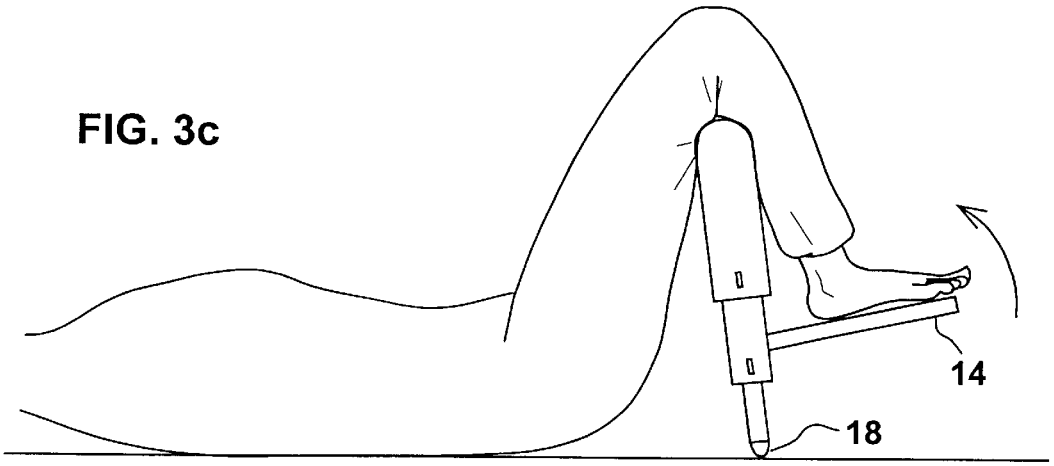

FIGS. 3*a*, 3*b* and 3*c* show a series of positions of device 10 during a stretching session. Prior to commencing the stretching, the user adjusts the heights of the respective frame members as described above by means of altering the respective lengths of the telescopic elements.

The stretching session consisting of repeated back and forth rocking of the user's legs with the lowermost portions of legs 12*a* and 12*b* serving as pivots.

The starting position of a single rocking cycle is shown in FIG. 3*a*. Here, the user's upper legs are oriented substantially vertically with device 10 angled. The user then pushes device 10 back with his legs and, primarily, with his feet (FIG. 3*b*) so that the upper legs are no longer substantially vertical, causing device 10 to become more vertical. Finally, as the user continues to push device 10 back with his feet and legs, the upper legs form a substantial angle with the ground while device 10 become substantially vertical.

As will be appreciated by carefully considering the sequence of FIGS. 3*a*–3*c*, the top of device 10 moves as an arc of a circle with a center as the bottom of legs 12*a* and 12*b* (i.e., point 18). Hence, as device 10 moves from its position in FIG. 3*a* to its position in FIG. 3*b* and then 3*c*, the user's legs are caused to be simultaneously pulled and lifted. Without in any way limiting the scope of the present invention, it is believed that it is this combination of pulling and lifting which exerts the beneficial effect and serves to effectively reduce and/or prevent lower back pains.

For best results, adjustments should be made so that when the user's feet are placed firmly on foot rest member 14 the back of the knees are supported by resting against the top of web 12*c*, or slightly higher.

As is well known, in such a position the lower back region tends to becomes more flattened, that is, the lower back region is able to achieve a close contact with the surface on which the user is lying. It is, however, desired, and is achieved after prolonged and regular use of device 10, that the lower back attain a certain arched shape (FIG. 3*a*).

As described above, the movements required to effect the relief of back pains consist of a slow rocking or to-and-fro oscillations of device 10. These movements are obtained primarily by the alternating pressing and releasing of the pressure of the balls of the feet on foot rest member 14. The amplitude of such oscillations is optimally in the range of 10 to 15 centimeters about the intermediate position shown in FIG. 3*b*. The pivoting of device 10 about the fulcrum (18) brings about the simultaneous virtually effortless, painless and relaxing stretching and lifting of the lumbar region which results in a slight flattening of the lower back (FIG. 10 3*c*).

The pressing action of the feet is maintained until device 10 reaches the position shown in FIG. 3*c*. When the pressure is released, device gradually reverts back to its starting position (FIG. 3*a*). The rate of the oscillations and the number of oscillation, or session duration, will depend on the relief required and the condition of the user's back. Typically, the relief of lower back pains might require two daily session of about 15 minutes each. The session may be utilized to watch television, listen to the radio or read.

Another embodiment of a device according to the represent invention is shown in FIGS. 4 and 5. Here, device 110 the upright legs supporting frame member are replaced by a corkscrew-shaped frame 112 whose principal features largely are as previously described with reference to the inverted U-shaped frame 12 (FIGS. 1 and 2).

Several differences between the embodiment of FIGS. 4 and 5 and that of FIGS. 1 and 2 should be noted. First, frame 112, which is adjustable, as before, through use of telescoping elements locked, for example, using set screws 116, includes a single leg 112*a* which supports web 112*c*. The use of a single leg 112*a*, and hence a single fulcrum (118) allows the user to twist device 110 laterally in addition to the back-and-forth movements described above with reference to the embodiment of FIGS. 1 and 2. This additional degree of freedom may enhance the value of device 110 for certain users.

A second difference, independent of the first, is the use in device 110 of additional means for adjusting the angle of foot rest member 114 with respect to column 112*a* through rotation about hinge 120. The adjusting means depicted in FIGS. 4 and 5 includes a wire 122 of adjustable effective length which is connected by eyelets 124 and 126, located on frame 112 and foot rest member 114, respectively. The adjustment means allows the user to adjust the inclination of foot rest member 114 relative to frame 112 to suit his personal convenience.

Another embodiment of a device according to the present invention is depicted in FIG. 6. Here, device 210 includes means for amplifying the moment of rotation of device 210 through the addition of a pulling force of the user's arms to the force exerted by the user's legs.

To this end, foot rest member 214 of device 210 is provided with a pair of depending cantilever arms 226 affixed at substantially right angles at the front or free ends thereof.

A pair of wires 228 are attached to arms 226 which allows the user to pull on device 210 using his arms to supplement the clockwise moment of rotation of frame 212 about the fulcrum (218) supplied by the user's feet and legs.

Depicted in FIGS. 7 and 8 is a motor-driven version of a device 310 according to the present invention. Device 310 primarily includes frame 312, as previously described, with reference to FIGS. 4 and 5. In contrast with the previously described embodiment, foot rest member 314 is rigidly affixed to frame 312 using corner pieces 314*a* and 314*b*.

A base unit 330 is provided at its top side with a cavity 330*a* for nesting the fulcrum support 318 of frame 312. Onto a front facing surface 330*b* of base unit 330 there is mounted an electric motor 332, coupled to or built-in with a pair of reduction gear transmission boxes 334*a* and 334*b*. Gear boxes 334*a* and 334*b* rotate wheels 336*a* and 336*b*, respectively, to which crank arms 338*a* and 338*b* are eccentrically coupled. The other ends of the cranks are each journalled to the front corners of foot rest member 314.

During the operation of device 310, output wheels 336*a* and 336*b* are rotated by motor 332 and by means of crank arms 338*a* and 338*b* generate the oscillating action of frame 312.

It will be noted that since base unit 330 supports the weight of the user's legs and of motor 332 and its associated parts, a counterbalance, stabilizing force is available sufficient to allow the apparatus to be used without the need for any external means to restrain device 310 and prevent it from toppling over.

Motor 332 is designed to be of simple construction and will be powered by house current or, preferably, by rechargeable batteries, so as to allow device 310 to be used where suitable house current is not available. The preferred frequency of the oscillating motions should be in the range of about 5–15 rpm, according to the user's preference.

While the invention has been described with respect to a limited number of embodiments, it will be appreciated that many variations, modifications and other applications of the invention may be made.

What is claimed is:

1. A method for relieving and preventing lower back pains, comprising the steps of:

(a) providing a device for simultaneously stretching and lifting a user's lower back, the device including:

(i) a frame including an upper cross frame member extending substantially horizontally, said frame having a lower end for contacting the ground and serving as a fulcrum; and (ii) a foot rest member mounted to said frame at a point intermediate said upper cross frame member and said lower end;

(b) lying with the user's back on the ground;

(c) holding said device so that said lower end is on the ground while said upper cross frame member is elevated relative to the ground;

(d) placing the user's legs over said device so that the user's feet rest on said foot rest member while the back of the user's knees rests substantially on said upper cross frame member; and (e) rocking said device back and forth about said lower end of said frame by periodically pushing on said foot rest member so as to simultaneously lift and stretch the user's lower back.

2. The method of claim 1, wherein said device includes means for adjusting the height of said upper cross frame member and further comprising adjusting the height of said upper cross frame member above the ground after the step of providing said device.

3. The method of claim 1, wherein said device includes means for adjusting the height of said foot rest member and further comprising adjusting the height of said foot rest member relative to said upper cross frame member after the step of providing said device.

4. The method of claim 1, wherein said device includes means for adjusting the angle between said foot rest and said frame and further comprising adjusting the angle between said foot rest member and said frame after the step of providing said device.

5. The method of claim 1, wherein said device further includes a pair of wires connected to said foot rest member and further comprising pulling said wires during said rocking of said device.

* * * * *